US007691237B2

(12) United States Patent
Westerkamp

(10) Patent No.: US 7,691,237 B2
(45) Date of Patent: Apr. 6, 2010

(54) BELT FOR TRANSFERRING AN IN-PRODUCTION FIBROUS WEB

(75) Inventor: Arved Westerkamp, Dettingen (DE)

(73) Assignee: Voith Paper GmbH (DE)

( * ) Notice: Subject to any disclaimer, the term of this patent is extended or adjusted under 35 U.S.C. 154(b) by 562 days.

(21) Appl. No.: 11/528,021

(22) Filed: Sep. 27, 2006

(65) Prior Publication Data

US 2007/0074836 A1 Apr. 5, 2007

(30) Foreign Application Priority Data

Sep. 30, 2005 (DE) ..... 10 2005 046 812

(51) Int. Cl.

| | |
|---|---|
| ***D21F 1/36*** | (2006.01) |
| ***D21F 7/12*** | (2006.01) |
| ***D21F 9/00*** | (2006.01) |
| ***B32B 33/00*** | (2006.01) |
| ***B32B 27/12*** | (2006.01) |

(52) U.S. Cl. ..... 162/306; 162/358.2; 162/358.4; 162/900; 162/901; 162/902; 428/194; 428/196; 442/101; 442/104

(58) Field of Classification Search ..... 162/348, 162/358.1, 358.2, 900, 902–904, 116, 361, 162/362, 306, 193; 139/383 A, 425 A, 383 AA; 198/846, 847; 442/64, 71, 74, 104, 76, 101, 442/148, 164; 428/194, 195.1, 196
See application file for complete search history.

(56) References Cited

U.S. PATENT DOCUMENTS

| | | | | |
|---|---|---|---|---|
| 3,032,441 | A * | 5/1962 | Beaumont et al. | 442/46 |
| 3,867,766 | A * | 2/1975 | Wagner | 34/95 |
| 4,460,023 | A * | 7/1984 | Mullaney | 139/383 A |
| 4,649,964 | A * | 3/1987 | Smith | 139/383 A |
| 4,877,472 | A * | 10/1989 | Rodal | 156/184 |
| 5,397,438 | A * | 3/1995 | Nyberg et al. | 162/207 |
| 6,042,695 | A * | 3/2000 | Ishino | 162/358.4 |
| 6,092,645 | A * | 7/2000 | Wahren | 198/847 |
| 6,116,156 | A * | 9/2000 | Schiel et al. | 100/118 |
| 6,605,188 | B2 | 8/2003 | Hagfors et al. | 162/306 |
| 6,709,552 | B2 * | 3/2004 | Sakuma et al. | 162/358.4 |
| 6,736,939 | B2 * | 5/2004 | Watanabe | 162/358.3 |
| 6,770,172 | B2 | 8/2004 | Rökman et al. | 162/358.2 |
| 6,780,287 | B2 * | 8/2004 | Sakuma et al. | 162/358.4 |
| 6,921,461 | B2 * | 7/2005 | Watanabe et al. | 162/358.4 |
| 2008/0205867 | A1 | 8/2008 | Gruber-Nadlinger et al. | |

FOREIGN PATENT DOCUMENTS

| | | |
|---|---|---|
| EP | 0576115 | 4/1996 |

* cited by examiner

*Primary Examiner*—Eric Hug
(74) *Attorney, Agent, or Firm*—Taylor & Aust, PC

(57) ABSTRACT

This invention relates to a belt for transferring an in-production fibrous web, in particular a paper web or paperboard web, in a machine area of a machine producing the fibrous web, in particular a paper machine or paperboard machine, including at least one textile substrate and a coating, which is applied to the substrate and touches the in-production fibrous web, for obtaining a partial or complete impermeability of the belt. The inventive belt has at least one continuously differencing characteristic in at least one region across its overall width. Also, this invention relates to a machine, in particular a paper machine or paperboard machine, for producing a fibrous web, in particular a paper web or paperboard web, as well as to a use of a belt for transferring an in-production fibrous web, in particular a paper web or paperboard web, in one machine area or between two machine areas of a machine producing the fibrous web, in particular a paper machine or paperboard machine.

14 Claims, 2 Drawing Sheets

BELT FOR TRANSFERRING AN IN-PRODUCTION FIBROUS WEB

BACKGROUND OF THE INVENTION

1. Field of the Invention

This invention relates to a belt for transferring an in-production fibrous web, in particular a paper web or paperboard web, in a machine area of a machine producing the fibrous web, in particular a paper machine or paperboard machine, including at least one textile substrate and a coating, which is applied to the substrate and touches the in-production fibrous web, for obtaining a partial or complete impermeability of the belt.

Also, this invention relates to a machine, in particular a paper machine or paperboard machine, for producing a fibrous web, in particular a paper web or paperboard web, as well as to a use of a belt for transferring an in-production fibrous web, in particular a paper web or paperboard web, in one machine area or between two machine areas of a machine producing the fibrous web, in particular a paper machine or paperboard machine.

2. Description of the Related Art

Such a belt for transferring an in-production fibrous web in a machine area of a machine producing the fibrous web is already known from a multiplicity of publications. The two publications EP 0 576 115 B1 (DE 693 02 136 T2) and U.S. Pat. No. 6,605,188 B2 can be cited purely by way of example.

The belt should generally guarantee stable running of the in-production fibrous web through the machine. This is important in particular in the machine areas in which the in-production fibrous web is not guided by a roller or a belt such as a mesh belt, a press felt or a dryer fabric.

The known belts all have different properties, in particular in the region of their surfaces facing the in-production fibrous web. From the previously mentioned publication EP 0 576 115 B1, for example, there is known a surface which comes into contact with the web and has a degree of roughness that reacts to and recovers from pressure. By contrast, the also mentioned publication U.S. Pat. No. 6,605,188 B2 discloses a belt which is includes of a basic structure and a surface layer touching the in-production fibrous web. In this case the surface layer includes at least two types of fiber with different properties such as hydrophilic versus hydrophobic for example. Other different properties can also be the polarities, the hydrophilic properties, the electric charges, the surface tensions, the coefficients of friction, the degrees of fineness or the porosities.

The different properties of the belts disclosed in the publications mentioned always refer to their overall areas, meaning across the overall widths of the belts in question. Hence it is not possible to make sufficient allowance for different transverse profiles of the respective fibrous web during production, with the result that a compromise involving quality losses and waste quotas must always be accepted.

Furthermore, the publication U.S. Pat. No. 6,770,172 B2 discloses an endless press felt which includes of one basic fabric and at least one fleece layer that has in its two edge regions a different structure respectively than in the middle region. However, the corresponding structure with respect to the regional area is the same in the various regions. In other words, this means that the respective regional area has a non-differencing characteristic. On the whole this embodiment results, among other things, in an improved guidance of the material web through the press nip.

What is needed in the art is a belt of the type initially referred to such that different transverse profiles of the fibrous web can be better compensated during its production. Also, a corresponding machine and a corresponding use are to be disclosed.

SUMMARY OF THE INVENTION

The present invention provides a belt of the type initially referred to such that the belt has at least one continuously differencing characteristic in at least one region across its overall width.

The fact that the belt has at least one continuously differencing characteristic in at least one region across its overall width creates the possibility of making better allowance for different, possibly machine-specific transverse profiles, such as the moisture profile of the fibrous web for example, during its production, meaning that is also possible, among other things, to compensate said transverse profiles. This possibility creates improved preconditions for producing a higher quality fibrous web with a distinctly better production and quality quota.

Furthermore, the essential object of the belt, namely to guide the in-production fibrous web through at least one press nip and subsequent open draws, is distinctly better accomplished.

Similarly, other objects of the belt such as harmonizing the flow of water and/or air at least while the in-production fibrous web is being guided through the press nip, are also better accomplished.

For example, the distribution of water in the in-production fibrous web can be optimized, at least in the press nip, as the result of a varying roughness (characteristic) across the overall width. The purpose of this is for the dewatering in the direction of the press felt to be harmonized, with the result that the dry content of the in-production fibrous web across the overall width of the machine is distinctly improved. At the same time it can also be deduced that the two-sidedness of the in-production fibrous web is improved because the potential erosion of filler materials can be controlled through the harmonization of the water flow.

In addition to this, the distribution of air in the so-called filter cake becomes controllable, at least in the press nip, as the result of a varying roughness (characteristic) across the overall width for example. Owing to the rough surface of the press felt, the air can escape under controlled conditions through the fine grooves which arise during the grinding process, thus contributing to a more homogeneous construction of the in-production fibrous web in respect of bulk and porosity for example.

According to the invention, several possibilities are advantageous for the three-dimensional definition of the characteristic: the characteristic differs in at least two regions symmetrically or in at least one region asymmetrically, in particular in random distribution toward the center of the belt, the characteristic differs solely in the two edge regions or in the middle region of the belt and/or the characteristic differs in several regions periodically and/or in several regions across the overall width of the belt. Furthermore, the respective differencing of the characteristic takes place in this case continuously. All these advantageous possibilities of differencing open up a large application spectrum to the inventive belt for fibrous webs with different, possibly machine-specific transverse profiles.

The characteristic includes in further refinement according to the invention at least one direct product parameter of the belt such as, for example, the material used, the thickness of the substrate, the depth of penetration of coatings, the constructional design of the belt or the like, and/or at least one indirect product parameter of the belt such as, for example, roughness, bending strength, compressibility, permeability, recovery capacity, pore distribution, pore size, pore size distribution or the like.

Also, the differencing characteristic results from an addition and/or deduction of material components or material fractions and/or from a change of the production process across the overall width of the belt. These two methods for producing the characteristic for the belt are characterized among other things by simplicity, speed and a cost advantage.

The machine, in particular a paper machine or paperboard machine, for producing a fibrous web, in particular a paper web or paperboard web, is characterized in that at least one machine area has a belt for transferring the in-production fibrous web. This machine area is the press section for dewatering and/or the drying section for drying the in-production fibrous web.

The use of a belt for transferring an in-production fibrous web, in particular a paper web or paperboard web, is provided in one machine area or between two machine areas of a machine producing the fibrous web, in particular a paper machine or paperboard machine. The machine area can be the press section for dewatering and/or the drying section for drying the in-production fibrous web.

BRIEF DESCRIPTION OF THE DRAWINGS

The above-mentioned and other features and advantages of this invention, and the manner of attaining them, will become more apparent and the invention will be better understood by reference to the following description of an embodiments of the invention taken in conjunction with the accompanying drawings, wherein.

Corresponding reference characters indicate corresponding parts throughout the several views. The exemplifications set out herein illustrate embodiments of the invention, and such exemplifications are not to be construed as limiting the scope of the invention in any manner.

DETAILED DESCRIPTION OF THE PREFERRED EMBODIMENT

Figure 1:
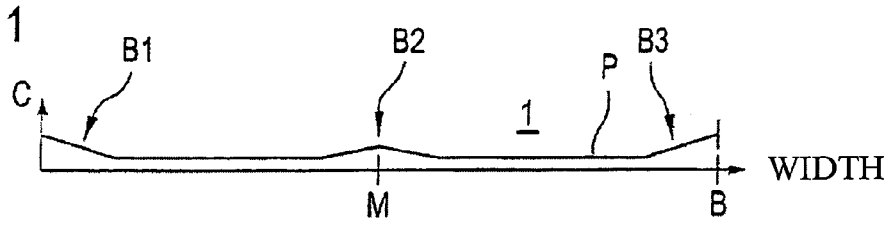
FIGS. 1 and 2 are two exemplary profiles for respectively one continuously differencing characteristic of an inventive belt across the width.
Figure 2:
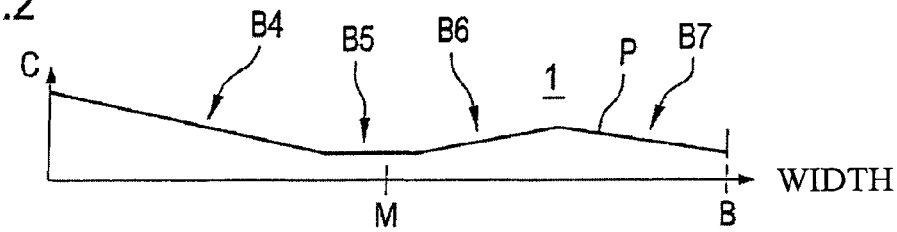

Referring now to the drawings, and more particularly to FIGS. 1 and 2, there is shown two exemplary profiles P for respectively one continuously differencing characteristic C of a belt 1 across the overall width B, said belt generally being used for transferring an in-production fibrous web, in particular a paper web or paperboard web, in a machine area of a machine producing the fibrous web, in particular a paper machine or paperboard machine, including at least one textile substrate and a coating, which is applied to the substrate and touches the in-production fibrous web, for obtaining a partial or complete impermeability of the belt 1 (compare FIGS. 5 to 8).

The respective belt 1 has one continuously differencing characteristic C across its overall width B.

According to the embodiment in FIG. 1, the characteristic C differs in three regions B1, B2 and B3 symmetrically to the belt center M, whereas according to the embodiment in FIG. 2 the characteristic C differs in the four regions B4, B5, B6 and B7 asymmetrically, in particular in random distribution toward the belt center M. Furthermore, the respective differencing of the characteristic C takes place in this case continuously.

In other embodiments, which are not explicitly shown however, the characteristic C can also differ continuously solely in the two edge regions of the belt 1, solely in the middle region of the belt 1, in several regions periodically across the overall width B of the belt 1 and/or in several regions across the overall width B of the belt 1.

Furthermore, the characteristic C includes at least one direct product parameter of the belt 1 such as, for example, the material used, the thickness of the substrate, the depth of penetration of coatings, the constructional design of the belt or the like, and/or at least one indirect product parameter of the belt 1 such as, for example, roughness, bending strength, compressibility, permeability, recovery capacity, pore distribution, pore size, pore size distribution or the like.

The differencing characteristic C results from an addition and/or deduction of material components or material fractions and/or from a change of the production process across the overall width B of the belt 1.

The respective belt 1 is also excellently suited for use in a machine area of a machine producing the fibrous web, in particular a paper machine or paperboard machine, whereby the machine area can be the press section for dewatering or the drying section for drying the fibrous web.

Figure 3:
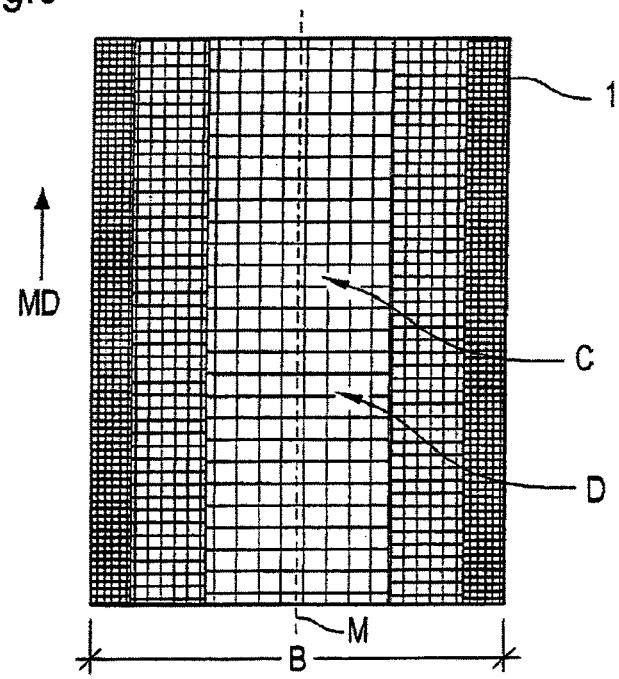
FIG. 3 is a plan view of an inventive belt with one continuously differencing characteristic across the overall width.

FIG. 3 shows a plan view of a belt 1, including the machine direction MD of the belt, with one continuously differencing characteristic C across the overall width B.

The selected characteristic C is, for example, the permeability D, which differs symmetrically toward the belt center M. The differencing permeability D can be effected by a different needling intensity across the overall width B of the belt 1. The needling intensity is highest in the two edge regions of the belt 1 and lowest in the region of the belt center M. Arranged in between these regions are regions with a medium needling intensity. The regions are implied by different intensities of hatching. In this case it is also evident that the characteristic C can be overlapped by two adjacent regions of the belt, meaning that there must not be any sharp dividing contour between the two adjacent regions of the belt.

Figure 4:
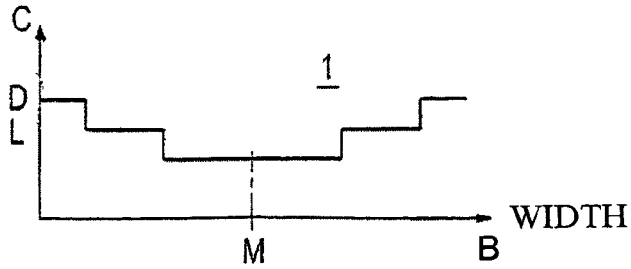
FIG. 4 is a schematic representation of the effect of the continuously differencing characteristic of the inventive belt in FIG. 3.

FIG. 4 shows a schematic representation of the effect of the differencing characteristic C of the belt 1 in FIG. 3.

The effect achieved in form of the permeability D, in particular in form of the air permeability L, varies symmetrically toward the belt center M and can vary in a range from greater than 0 to 10 cfm for example.

FIGS. 5 to 8 all show respectively a sectional representation of a possible embodiment of the inventive belt 1, which includes at least one textile substrate 2 and a coating 3, which is applied to the substrate 2 and touches the fibrous web (not illustrated), for obtaining a partial or complete impermeability of the belt 1. In this case the substrate 2 has a load-carrying structure.

Furthermore, the belt 1 shown respectively in FIGS. 5 to 8 has a continuously differencing characteristic across its overall width, as is shown in FIGS. 1 and 2 for example.

Figure 5:
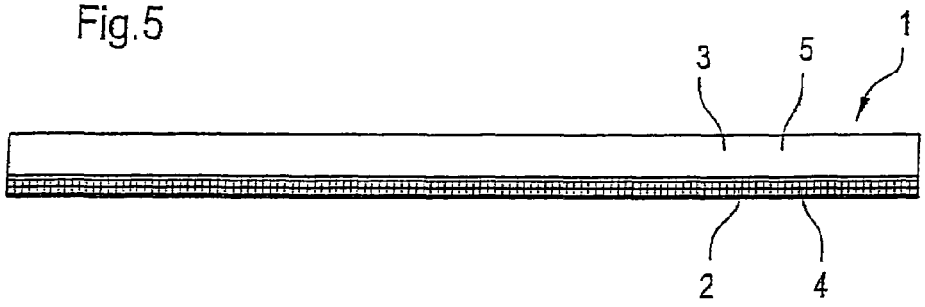
FIGS. 5 to 8 are several sectional representations of possible embodiments of the belt according to the present invention.

On the embodiment in FIG. 5, the belt 1 is formed from two separate layers, namely from a carrier layer 4 formed from a textile substrate 2, and a surface layer 5 formed from a coating 3.

Figure 6:
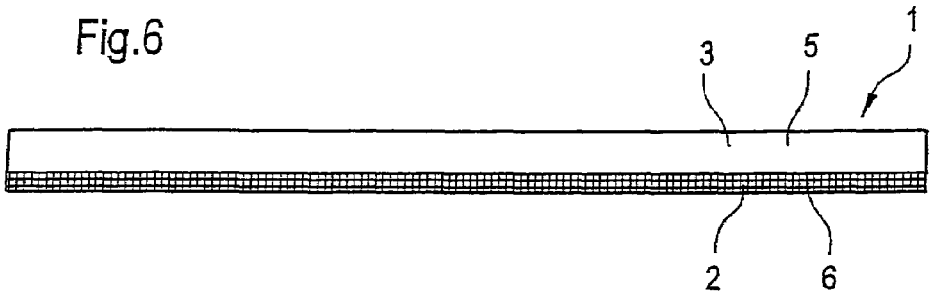

By contrast, on the embodiment in FIG. 6 there is a coating 3 which penetrates, fully or partly, a textile substrate 2. Hence the belt 1 includes a pure surface layer 5, which is formed solely from the coating 3, and a mixed layer 6, which is formed from the textile substrate 2 and the coating 3.

Figure 7:
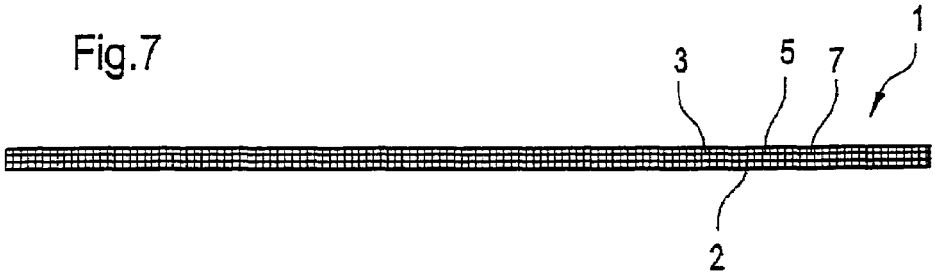

Furthermore, the belt 1 on the embodiment in FIG. 7 similarly includes a mixed layer 7, which again is formed from a textile substrate 2 and a coating 3 in reciprocal combination. In this case the coating 3 is again a part of the surface layer 5.

Figure 8:
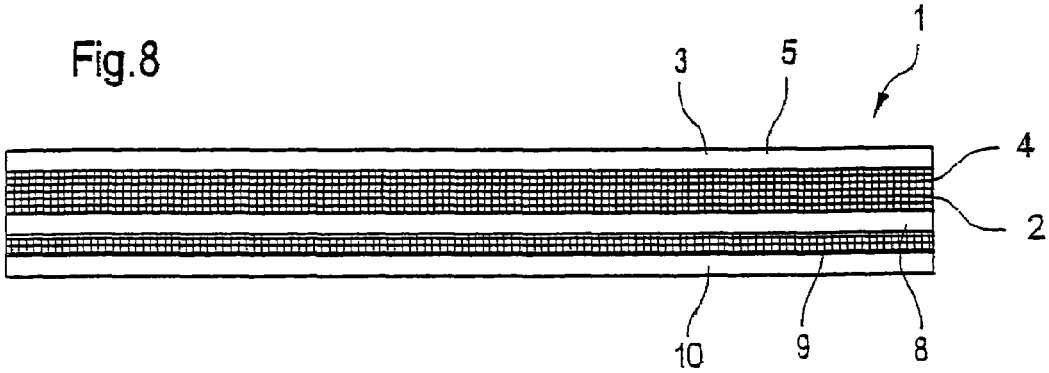

And finally the belt 1 on the embodiment in FIG. 8 has a layered construction with multiple layers. A coating 3 forms a surface layer 5 touching the fibrous web (not illustrated), and an adjacent carrier layer 4 underneath is formed by a textile substrate 2.

Also applied to the bottom side of the carrier layer 4 are three more layers 8, 9 and 10, which again have load-carrying structures and properties.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claim.

According to an embodiment of the present invention, a belt of the type initially referred to is developed further such that different transverse profiles of the fibrous web can be better compensated during its production. In addition, this can result in effects which are visible in a quality improvement, meaning for example more homogeneous values for gloss, volume and the like across the overall width, as well as in an increase of the machine's production capacity, meaning fewer tears/breaks of the material web.

List of reference numerals

| | |
|---|---|
| 1 | Belt (transfer belt) |
| 2 | Substrate |
| 3 | Coating |
| 4 | Carrier layer |
| 5 | Surface layer |
| 6 | Mixed layer |
| 7 | Mixed layer |
| 8 | Layer |
| 9 | Layer |
| 10 | Layer |
| B | Overall width |
| B1 to B7 | Region |
| C | Characteristic |
| D | Permeability |
| L | Air permeability |
| M | Belt center |
| MD | Machine direction |
| P | Profile |

What is claimed is:

1. A belt for transferring an in-production fibrous web in a machine area for producing the fibrous web, said belt comprising:

at least one textile substrate;

at least one coating applied to said at least one textile substrate and touching the in-production fibrous web, said at least one coating configured for obtaining a complete impermeability of the belt;

said belt having a plurality of regions, and at least one continuously differencing characteristic in at least one of said plurality of regions across an overall width of the belt, said characteristic including at least one of a plurality of indirect product parameters of the belt including a roughness, a bending strength, a compressibility, and a recovery capacity, said characteristic being continuously differencing in at least one of said plurality of regions asymmetrically, in random distribution, toward a belt center of the belt.

2. The belt according to claim 1, wherein said characteristic is continuously differencing in several of said plurality of regions across said overall width of the belt.

3. The belt according to claim 1, wherein said characteristic comprises at least one of a plurality of direct product parameters of the belt including a material used, a thickness of said substrate, a depth of penetration of said at least one coating, and a constructional design of the belt.

4. The belt according to claim 1, wherein said differencing characteristic of the belt is formed by at least one of adding and deducting one of a plurality of material components and a plurality of material fractions.

5. The belt according to claim 1, wherein said differencing characteristic of the belt is formed by changing a production process across said overall width of the belt.

6. A belt for transferring an in-production fibrous web in a machine area for producing the fibrous web, said belt comprising:

at least one textile substrate;

at least one coating applied to said at least one textile substrate and touching the in-production fibrous web, said at least one coating configured for obtaining a complete impermeability of the belt;

said belt having a plurality of regions, and at least one continuously differencing characteristic in at least one of said plurality of regions across an overall width of the belt, said characteristic including at least one of a plurality of indirect product parameters of the belt including a roughness, a bending strength, a compressibility, and a recovery capacity, wherein said plurality of regions comprises two edge regions of the belt, said characteristic being continuously differencing solely in said two edge regions of the belt.

7. A belt for transferring an in-production fibrous web in a machine area for producing the fibrous web, said belt comprising:

at least one textile substrate;

at least one coating applied to said at least one textile substrate and touching the in-production fibrous web, said at least one coating configured for obtaining a complete impermeability of the belt;

said belt having a plurality of regions, and at least one continuously differencing characteristic in at least one of said plurality of regions across an overall width of the belt, said characteristic including at least one of a plurality of indirect product parameters of the belt including a roughness, a bending strength, a compressibility, and a recovery capacity, wherein said plurality of regions comprises a middle region of the belt, said characteristic being continuously differencing solely in said middle region of the belt.

8. A belt for transferring an in-production fibrous web in a machine area for producing the fibrous web, said belt comprising:

at least one textile substrate;

at least one coating applied to said at least one textile substrate and touching the in-production fibrous web, said at least one coating configured for obtaining a complete impermeability of the belt;

said belt having a plurality of regions, and at least one continuously differencing characteristic in at least one of said plurality of regions across an overall width of the belt, said characteristic including at least one of a plurality of indirect product parameters of the belt including a roughness, a bending strength, a compressibility, and a recovery capacity, wherein said characteristic is continuously differencing in several of said plurality of regions periodically across said overall width of the belt.

9. A machine for producing a fibrous web, said machine having a machine area, said machine comprising:

a belt in the machine area for transferring an in-production said fibrous web, said belt comprising:

at least one textile substrate;

at least one coating applied to said at least one textile substrate and touching said in-production fibrous web, said at least one coating configured for obtaining a complete impermeability of said belt;

a plurality of regions, and at least one continuously differencing characteristic in at least one of said plurality of regions across an overall width of said belt, said characteristic including at least one of a plurality of indirect product parameters of the belt including a roughness, a bending strength, a compressibility, and a recovery capacity, said characteristic being continuously differencing in at least one of said plurality of regions asymmetrically, in random distribution, toward a belt center of the belt.

10. The machine according to claim 9, wherein said machine area is at least one of a press section for dewatering the fibrous web and a drying section for drying the fibrous web.

11. A method of using a belt of a machine for producing a fibrous web, said method comprising the steps of:

providing the belt for transferring an in-production said fibrous web, the belt comprising:

at least one textile substrate;

at least one coating applied to said at least one textile substrate and touching said in-production fibrous web, said at least one coating configured for obtaining a complete impermeability of the belt, the belt having a plurality of regions, and at least one continuously differencing characteristic in at least one of said plurality of regions across an overall width of the belt, said characteristic including at least one of a plurality of indirect product parameters of the belt including a roughness, a bending strength, a compressibility, and a recovery capacity, said characteristic being continuously differencing in at least one of said plurality of regions asymmetrically, in random distribution, toward a belt center of the belt; and transferring said in-production fibrous web between two machine areas of the machine producing the fibrous web.

12. The method of claim 11, further including the step of transferring said in-production fibrous web in one of said machine areas of the machine producing the fibrous web.

13. A method of using a belt of a machine for producing a fibrous web, said method comprising the steps of:

providing the belt for transferring an in-production said fibrous web, the belt comprising:

at least one textile substrate;

at least one coating applied to said at least one textile substrate and touching said in-production fibrous web, said at least one coating configured for obtaining a complete impermeability of the belt, the belt having a plurality of regions, and at least one continuously differencing characteristic in at least one of said plurality of regions across an overall width of the belt, said characteristic including at least one of a plurality of indirect product parameters of the belt including a roughness, a bending strength, a compressibility, and a recovery capacity, said characteristic being continuously differencing in at least one of said plurality of regions asymmetrically, in random distribution, toward a belt center of the belt; and transferring said in-production fibrous web between a press section of the machine producing the fibrous web and a drying section of the machine producing the fibrous web.

14. The method of claim 13, further including the step of transferring said in-production fibrous web in said press section of the machine producing the fibrous web.

* * * * *